US010683188B2

(12) United States Patent
Griesshammer

(10) Patent No.: US 10,683,188 B2
(45) Date of Patent: Jun. 16, 2020

(54) METHOD FOR OPERATING A TEXTILE MACHINE, AND TEXTILE MACHINE FOR PRODUCING ROVING

(71) Applicant: Maschinenfabrik Rieter AG, Winterthur (CH)

(72) Inventor: Christian Griesshammer, Winterthur (CH)

(73) Assignee: MASCHINENFABRIK RIETER AG, Winterthur (CH)

( * ) Notice: Subject to any disclaimer, the term of this patent is extended or adjusted under 35 U.S.C. 154(b) by 738 days.

(21) Appl. No.: 15/313,453

(22) PCT Filed: May 7, 2015

(86) PCT No.: PCT/IB2015/000648
§ 371 (c)(1),
(2) Date: Nov. 22, 2016

(87) PCT Pub. No.: WO2015/181598
PCT Pub. Date: Dec. 3, 2015

(65) Prior Publication Data

US 2017/0101287 A1 Apr. 13, 2017

(30) Foreign Application Priority Data

May 26, 2014 (CH) ..... 0797/14

(51) Int. Cl.
*B65H 63/02* (2006.01)
*D01H 13/16* (2006.01)
(Continued)

(52) U.S. Cl.
CPC ..... *B65H 63/02* (2013.01); *B65H 54/02* (2013.01); *B65H 63/024* (2013.01); *B65H 67/04* (2013.01);
(Continued)

(58) Field of Classification Search
CPC ..... B65H 54/02; B65H 63/024; B65H 67/04; B65H 67/0422; D01H 7/92; D01H 9/04; D01H 9/16
See application file for complete search history.

(56) References Cited

U.S. PATENT DOCUMENTS 3,902,308 A 9/1975 Bernstein et al.
4,028,874 A 6/1977 Maag et al.
(Continued)

FOREIGN PATENT DOCUMENTS

DE 24 47 715 A1 4/1976
DE 37 34 565 A1 5/1989
(Continued)

OTHER PUBLICATIONS

Eric Oxtoby, Spun Yarn Technology, p. 105 (Year: 1987).*
PCT Search Reprt, dated Aug. 20, 2015.
Swiss Patent Office Search Report, dated Nov. 6, 2014.

*Primary Examiner* — Shaun R Hurley
(74) *Attorney, Agent, or Firm* — Dority & Manning, P.A.

(57) ABSTRACT

During normal operation of a textile machine, a fiber bundle is supplied to a consolidating means to produce a roving having a protective twist, the roving wound onto a tube with a winding device. The roving downstream of the consolidating means is monitored for whether the roving is being produced by the consolidating means or whether the roving produced by the consolidating means is being wound onto the tube. In no roving is being produced or the roving produced by the consolidating means is not being wound onto the tube, an interruption of the normal operation of the textile machine is initiated and the tube partly loaded with roving by the winding device prior to the interruption is replaced with an empty tube during a tube changing process. The consolidating means is started up and the roving produced thereby is brought into contact with the empty tube.
(Continued)

Normal operation is resumed and the roving is wound onto the empty tube.

13 Claims, 4 Drawing Sheets

(51) Int. Cl.

| | |
|---|---|
| ***B65H 67/04*** | (2006.01) |
| ***D01H 9/16*** | (2006.01) |
| ***D01H 7/92*** | (2006.01) |
| ***D01H 9/04*** | (2006.01) |
| ***B65H 54/02*** | (2006.01) |
| ***B65H 63/024*** | (2006.01) |
| *D01H 1/115* | (2006.01) |

(52) U.S. Cl.
CPC ..... *B65H 67/0422* (2013.01); *D01H 7/92* (2013.01); *D01H 9/04* (2013.01); *D01H 9/16* (2013.01); *D01H 13/16* (2013.01); *B65H 2701/31* (2013.01); *B65H 2701/311* (2013.01); *D01H 1/115* (2013.01)

(56) References Cited

U.S. PATENT DOCUMENTS

| | | | | |
|---|---|---|---|---|
| 5,022,222 | A | 6/1991 | Rupert et al. | |
| 5,237,807 | A * | 8/1993 | Iwade | D01H 13/145 188/158 |
| 8,042,324 | B2 | 10/2011 | Griesshammer et al. | |
| 2009/0289141 | A1* | 11/2009 | Griesshammer | D01H 1/36 242/484.6 |
| 2012/0285134 | A1* | 11/2012 | Betz | D01H 7/92 57/1 R |
| 2015/0082766 | A1 | 3/2015 | Stahlecker et al. | |
| 2017/0247817 | A1* | 8/2017 | Haska | B65H 67/048 |

FOREIGN PATENT DOCUMENTS

| | | | |
|---|---|---|---|
| DE | 40 32 116 | A1 | 4/1992 |
| DE | 10 2013 014 195 | A1 | 5/2014 |
| EP | 2 112 258 | A2 | 10/2009 |
| EP | 2 455 318 | | 5/2012 |
| WO | 24 43 920 | A1 | 3/1975 |
| WO | WO 2009/0086646 | A1 | 7/2009 |
| WO | WO 2013/143874 | A1 | 10/2013 |

* cited by examiner

METHOD FOR OPERATING A TEXTILE MACHINE, AND TEXTILE MACHINE FOR PRODUCING ROVING

FIELD OF THE INVENTION

The present invention relates to a method for operating a textile machine that produces roving, wherein during normal operation a fiber bundle is supplied to at least one consolidating means of the textile machine and a roving having a protective twist is produced from the fiber bundle by means of the consolidating means. After leaving the consolidating means and using a winding device arranged downstream of the consolidating means in a transport direction of the roving, the roving is wound onto a tube. A sensor system monitors whether a roving is being produced by the consolidating means and/or whether the roving produced by the consolidating means is being wound onto the tube.

Furthermore, a textile machine is suggested for producing roving having at least one consolidating means, by means of which during normal operation a roving having a protective twist is produced from a fiber bundle supplied to the consolidating means. In addition, the textile machine has a winding device that is arranged downstream of the consolidating means in a transport direction of the roving for winding the roving produced by the consolidating means onto a tube, and a tube changing device that is used to replace a tube loaded by the winding device with an empty tube. The textile machine furthermore includes an arrangement by means of which a start process may be performed in which roving produced by the consolidating means after the latter has been started up is brought into contact with an empty tube located in the region of the winding device and is then wound onto the latter. Finally, the textile machine includes a sensor system that is embodied to monitor whether a roving is being produced by the consolidating means and/or whether the roving is being wound onto the tube.

BACKGROUND

Roving is produced from slivers which are usually pretreated (for example doubled) by drafting and serves as a feed for the subsequent spinning process, in which the individual fibers of the roving are spun, for example by means of a ring spinning machine, to form a yarn. In order to give the roving the strength necessary for the further processing, it has proven to be advantageous, during production of the roving, to draft the supplied fiber bundle by means of a drafting system, which is usually part of the spinning preparation machine in question, and then to provide it with a protective twist. The strength is important in order to prevent breaking of the roving during the winding onto a tube and/or during the feeding thereof to the downstream spinning machine. The applied protective twist must, on the one hand, be strong enough to ensure that a cohesion of the individual fibers during the individual winding and unwinding processes and corresponding transport processes between the respective types of machine is ensured. On the other hand, it must also be ensured that, despite the protective twist, the roving can be further processed in a spinning machine—the roving must therefore still be able to be drafted.

For producing such a roving, in the past so-called flyers were used, the delivery speed of which is nevertheless limited due to centrifugal forces that occur. There have therefore already been many proposals to avoid the flyers or to replace them with an alternative type of machine.

In this connection, it has also already been proposed, inter alia, to produce roving by means of air-jet spinning machines, in which the protective twist is created by means of swirled air flows. The basic principle here consists in guiding a fiber bundle through a consolidating means designed as an air spinning nozzle, in which an air vortex is generated. The latter finally effects that some of the outer fibers of the supplied fiber bundle are wrapped as so-called wrapping fibers around the centrally running fiber strand, which in turn consists of core fibers running substantially parallel to one another.

Another method for roving production is disclosed in DE 24 47 715 A1. The consolidation of the unconsolidated fiber bundle described therein takes place by a consolidating means which brings about not a twisting, but rather a helical wrapping of a sliver with one or more filament yarns, preferably monofilament yarns, which hold the fiber bundle together and give it its strength. The spirals of the individual filament yarns may in this case be arranged in the same direction or in opposite directions. Preference is given to two filament yarns which are arranged in opposite directions of rotation and in a manner crossing over one another. The roving produced in this way is thus composed essentially of a sliver of parallel staple fibers and one or more fine-titer filament yarns wrapping helically around the sliver.

There are various possibilities for wrapping the filament yarn or filament yarns around the unconsolidated fiber bundle. For example, the filament yarn can be applied onto small bobbins of small diameter. The filament yarn is then drawn off from the stationary bobbin and drawn through the bobbin axis together with the fiber bundle, whereby the filament yarn is wrapped around the fiber bundle and the number of windings drawn off from the bobbin corresponds to the number of wraps applied to the fiber bundle. In principle, it is also possible to design the consolidating means in such a way that only the unconsolidated fiber bundle is guided through the bobbin axis, so as to hereby relocate the winding process to behind the filament yarn bobbin. The wrapping point should in this case be defined by a suitable thread guide.

Another method for producing roving is described in WO 2009/086646 A1, wherein the method comprises the following steps: 1) providing a fiber bundle in the form of two, preferably untwisted, slivers, 2) applying S and Z twists over alternating regions of the two slivers, wherein regions of S and Z twists on the respective sliver are separated by regions without any twist, 3) bringing together the two slivers provided with S and Z twists to form a roving, wherein the two slivers automatically twist together on account of their tendency to twist back.

The S and Z twists may be created for example by means of two elements of the consolidating means used, which hold the respective sliver in a clamped manner, wherein at least one element, preferably both elements, apply opposite twists on the sliver in an alternating manner on both sides by a relative movement on the surface thereof transversely to the longitudinal direction of the sliver. At the same time, the respective sliver is moved in the sliver direction. However, the S and Z twists can also be created by means of an aerodynamic, in particular pneumatic, method.

The alternating S and Z twists are moreover interrupted by intermediate regions without any twist. The two slivers provided with S and Z twists in the same way are finally brought together at the so-called joining point. Here, the slivers start to twist together automatically, that is to say they wind around each other. This so-called double-folding maintains the S and Z twists in the individual slivers, so that a self-stabilizing two-component roving is obtained. In principle, however, care should be taken here to ensure that the regions without any twist in the first sliver should be arranged offset in the longitudinal direction relative to the regions without any twist in the second sliver, so that two regions without any twist in the first and second sliver never lie next to one another in the resulting roving, since the strength of the roving depends substantially on the phase position of the regions without any twist in the two slivers. As described above, the rovings are therefore always brought together by the consolidating means in such a way that their regions without any twist lie out of phase. The roving produced in this way ultimately has a greater strength than an untwisted fiber bundle, said strength ultimately being sufficient to wind the roving onto a bobbin and unwind it again from the latter without false drafts.

However, if there are interruptions in the roving production process, for instance because the roving between the consolidating means and the winding device breaks or because the consolidating means is clogged up, the roving that is already wound onto the tube must be joined to the roving produced by the consolidating means after the latter is restarted, since the tube should be loaded with one continuous roving strand. This is time-consuming, however, and therefore affects the productivity of the textile machine in question.

SUMMARY OF THE INVENTION

An object of the present invention is therefore to suggest a method for operating a textile machine and such a textile machine that do not have these disadvantages. Additional objects and advantages of the invention will be set forth in part in the following description, or may be obvious from the description, or may be learned through practice of the invention.

The objects are attained using a method and a textile machine having the features described and claimed herein.

In accordance with the invention, the method is characterized in that, in the event that it is detected by means of the mentioned sensor system that the consolidating means does not produce roving or that the roving produced by the consolidating means is not wound onto the tube, an interruption of the normal operation takes place. The interruption may occur for instance when the consolidating means becomes clogged up when the fiber bundle is being supplied so that no more roving can be produced. The roving may also break between the consolidating means and the winding device so that the roving produced thereafter by the consolidating means can no longer travel to the region of the winding device or to a traversing device associated therewith (which guides the roving during the winding process in a traversing back and forth movement along the rotational axis of the tube). When normal operation is interrupted, the air supply for the consolidating means, embodied for instance as an air spinning nozzle, is preferably interrupted. Likewise, the winding device or a drive that causes the tube to rotate during normal operation is also stopped. Likewise, any draw-off device that is present (e.g. a pair of draw-off rollers arranged downstream of the consolidating means) and any traversing device that is present should be stopped.

In order to avoid a joining process between the roving delivered by the consolidating means after normal operation has resumed and the roving that is already disposed on the tube, it is suggested that the tube already partly loaded with roving by the winding device prior to the interruption in normal operation be replaced by an empty tube during a tube changing process after the interruption in normal operation. The partly loaded tube is thus removed from the winding device, and piecing the roving just delivered by the consolidating means to the roving already present on the tube is not required. Once an empty tube is disposed in the region of the winding device, at which winding device the partly loaded tube was disposed prior to the interruption, a start process is conducted in which after the consolidating means is started up, the roving produced thereby is brought into contact with the empty (new) tube. In doing so, one or a plurality of roving handling devices of an arrangement may be used that grip the roving coming from the consolidating means and move it into the region of the winding device or the aforesaid traversing device. As soon as the roving is brought into contact with the empty tube or is gripped thereby (i.e. following the start process), the roving produced by the consolidating means is wound onto the tube and normal operation is resumed.

As a result, therefore, in the present invention, a tube disposed in the winding device is loaded with roving only until it is loaded to a predetermined degree or until there is an unintended interruption in roving production by the consolidating means or until the winding of the roving supplied by the consolidating means onto the tube fails for some reason.

In this context it should be stressed that interruption to normal operation always occurs when planned roving production is stopped by the workstation or planned winding of the produced roving is stopped due to an unforeseen occurrence. Likewise, the start process and the subsequent return to normal operation may occur after the textile machine or one or a plurality of workstations thereof (each of which comprises at least one consolidating means and one winding device) is intentionally stopped, i.e. when roving production occurs due to an intentional stop in the corresponding segments, for instance due to a change of the container providing the fiber bundle.

At this point it should also be pointed out in principle (and thus also in connection with the inventive textile machine described in even greater detail below) that the consolidating means may be designed in various ways. For example, it would be conceivable that the consolidating means is suitable for producing the roving in the manner described in the abovementioned documents WO 2009/086646 A1 and DE 24 47 715 A1.

Preferably, however, the textile machine is designed as an air-jet spinning machine and the consolidating means is designed as an air spinning nozzle, by means of which the protective twist in the roving is created, as described above, by means of swirled air flows (part of such a textile machine designed as an air-jet spinning machine is described by way of example in the description of the figures).

In particular, it is advantageous when, during an interruption in normal operation, a drafting system that serves for drafting the fiber bundle and that is arranged upstream of the consolidating means in the transport direction is stopped. This ensures that no more fiber bundle is supplied to the consolidating means after the interruption in normal operation. In this case, the consolidating means may be freed of impurities or clogging so that roving may be reliably produced again during the start process. Likewise, when the consolidating means is embodied as an air spinning nozzle, it is advantageous when, during an interruption, the supply of the air introduced into the spinning nozzle during normal operation to generate the swirled air flow is stopped so that the spinning nozzle can be cleaned. As soon as the aforesaid start process is carried out (or shortly prior thereto), the drafting system is finally restarted and the consolidating means, or the air supply to the air spinning nozzle that forms the consolidating means, is activated to enable the required roving production in this step. Likewise, any draw-off device present or the aforesaid traversing device is restarted to ensure the roving is guided between consolidating means and winding device or tube.

It is furthermore advantageous when the roving produced by the consolidating means during normal operation is monitored between the consolidating means and the tube currently being loaded for one or a plurality of physical characteristics. The characteristics may be the current thickness of the roving or deviations in the roving from a target value (range) or may be the values of these averaged over a certain time period. As soon as it is determined, preferably by means of one or a plurality of sensors in the sensor system, that one or a plurality of characteristics deviates or deviate in a specific manner from one or a plurality of target value(s), normal operation is interrupted and the aforesaid method steps are performed, i.e. the tube changing process, start process, and resumption of normal operation. Roving production may also be carried automatically when there are unintended interruptions, wherein the appropriate tubes are always replaced with an empty tube when there is an interruption in the roving strand coming to the winding device.

It is advantageous when tubes that were completely loaded according to a predetermined target value during normal operation and tubes that were only partly loaded with roving due to an interruption in normal operation are transported to separate collection or transfer points after the respective tube changing processes. This may take place in that the separate collection or transfer units are arranged immediately in the vicinity of the winding device, and in that the tube changing device transfers the tubes to one of the two points, depending on the degree of loading (i.e. whether the tube is completely or only partly loaded with roving according to the respective requirements). Likewise, a plurality of transport devices (for instance in the form of conveyor belts) may be assigned to the tube changing device. In this case, the tube changing device transfers the corresponding tube to one of the transport devices, depending on the degree to which it is loaded. Thus, it would be possible for a first transport device to receive only the completely wound tubes and for a second transport device to receive only the tubes that are only partly loaded due to an interruption in normal operation, and to transport them to appropriate removal or storage sites. Naturally, it would also be possible that only one transport device is associated with the tube changing device, which transport device itself has one or a plurality of switch points by means of which the tubes may be conducted to subsequent transport devices or removal or storage places, depending on how full they are.

Likewise, it is advantageous if, after an interruption in normal operation has occurred and prior to the subsequent resumption of normal operation, the consolidating means is cleaned in order to remove from the consolidating means fibers of the fiber bundle and/or of the roving that are still disposed in the consolidating means. The cleaning may also be performed, for instance, by (preferably automatically) introducing compressed air, or may be performed manually. Likewise, cleaning of the drafting system, of any draw-off device that is present, or the aforesaid traversing device may be carried out if prior to the interruption in normal operation there were blockages or other unintended deposits of fibers of the fiber bundle or roving.

It is advantageous if the start-up of the consolidating means (i.e. the method step in which the interruption of normal operation produces and outputs roving again) mentioned above in connection with the start process is performed during or after the tube changing process. This ensures that the roving leaving the consolidating means does not arrive in the region of the winding device until an empty tube for loading is already available there.

It is also advantageous when the tube changing process, the start process, and the resumption of normal operation occurs within a maximum of 120 seconds after the preceding interruption in normal operation, preferably within a maximum of 60 seconds, particularly preferably within no more than 40 seconds after the preceding interruption in normal operation. An excessively long interruption in normal operation is hereby prevented, resulting in higher productivity for the textile machine. The aforesaid method segments may be performed one after the other or overlapping in time.

Finally, the inventive textile machine (which may include one or a plurality of the aforesaid workstations) is characterized in that it is assigned a control that is embodied for interrupting normal operation when it obtains from the sensor system the signal that no roving is being produced by the consolidating means or that the roving being produced by the consolidating means is not being wound onto the tube. Furthermore, the control is embodied to activate the tube changing device after the interruption in normal operation such that the tube that was partly loaded with roving by means of the winding device prior to the interruption in normal operation is replaced by an empty tube during a tube changing process. Likewise, the control is embodied to activate the aforesaid arrangement such that it performs a start process in which the roving produced by the consolidating means during a start-up of the consolidating means following an interruption in normal operation is brought into contact with the empty tube. Finally, the control is embodied to activate the control device such that the roving brought into contact with the tube is wound onto the tube, and to operate the textile machine in normal operation thereafter. Thus, in principle, the control is designed to operate the textile machine in accordance with the inventive method described in detail in the foregoing, wherein the control may be embodied to implement the individual above-described advantageous refinements of the method individually or in any desired combination.

The sensor system may comprise for instance one or a plurality of optical or capacitive sensors that monitor the roving flow between the consolidating means and the winding device. In this case, the control should be embodied to interrupt the described normal operation and to initiate the aforesaid method steps when the sensor system recognizes that the flow of the roving between the consolidating means and the winding device is interrupted, even though the textile machine or the corresponding workstation thereof is actually in normal operation.

Moreover, it is advantageous when the sensor system is embodied to monitor the roving produced by the consolidating means during normal operation between the consolidating means and the tube currently being loaded for one or a plurality of physical characteristics (for instance the thickness of the roving, or fluctuations in the thickness over time). In this case, the control should be embodied to interrupt normal operation when one or a plurality of characteristics deviates or deviate in a specific manner from one or a plurality of target value(s). In addition, the control should be embodied to activate the tube changing device, the aforesaid arrangement, and the winding device in accordance with the aforesaid description, and to subsequently operate the textile machine in normal operation.

BRIEF DESCRIPTION OF THE DRAWINGS

Further advantages of the invention are described in the following exemplary embodiments, in which.

DETAILED DESCRIPTION

Figure 1:
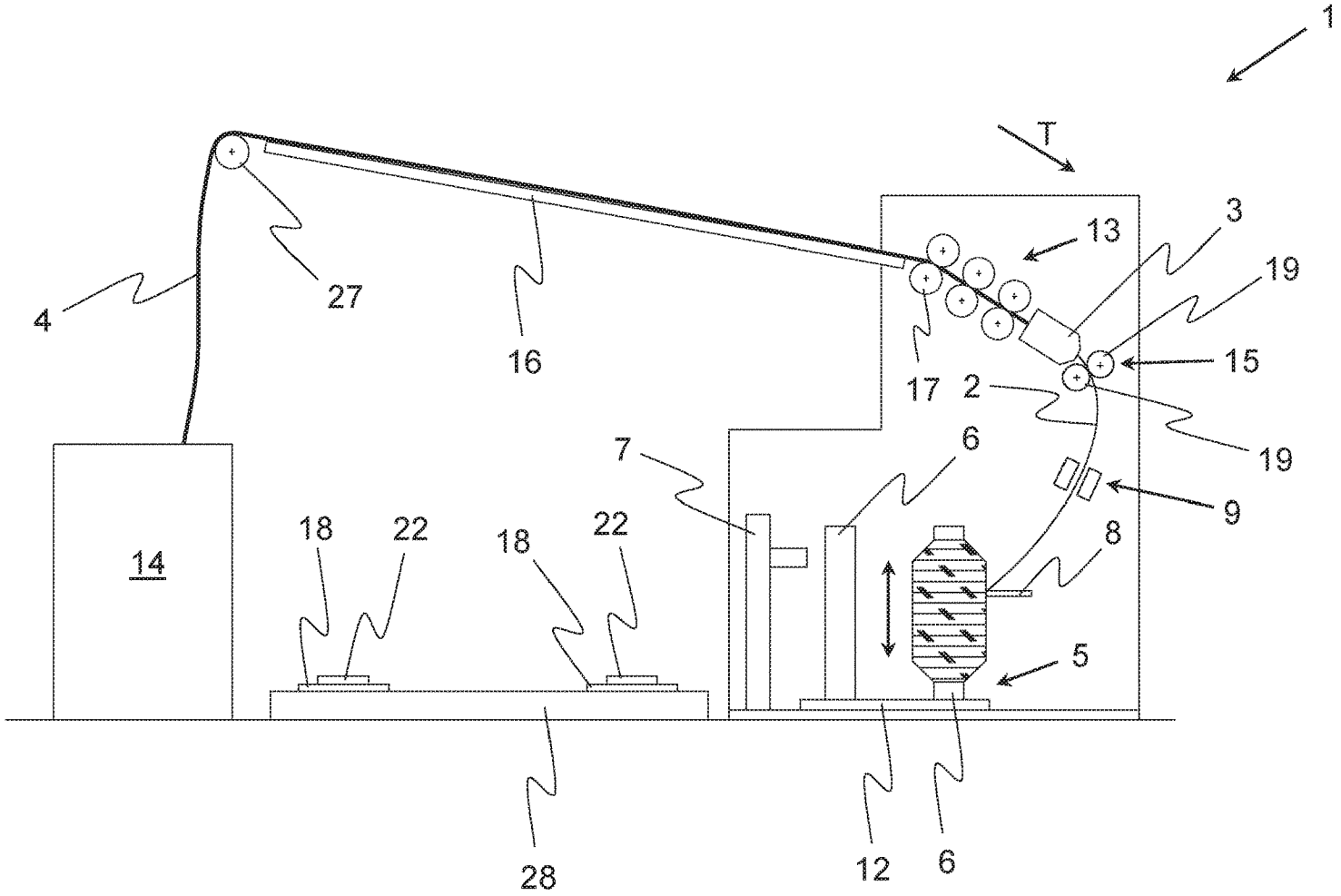
FIG. 1 is a side view of a textile machine according to the invention in the form of an air-jet spinning machine, and, FIGS. 2 through 4 depict a segment of a start process on a textile machine in the form of an air-jet spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 is a schematic side view of a textile machine according to the invention in the form of an air-jet spinning machine 1 that serves as an example of such a textile machine and produces roving 2. The air-jet spinning machine 1 preferably comprises a drafting system 13 with a plurality of corresponding drafting system rollers 17 (only one of the six illustrated drafting system rollers 17 is provided with a reference number) that is supplied with a fiber bundle 4, for instance in the form of a doubled drafter sliver.

The fiber bundle 4 generally originates from a container 14 (e.g. a sliver can) and may be supplied via a guide 16 to the drafting system 13, preferably after passing through a guide roller 27, wherein the guide 16 may also be embodied for instance as an elongate profile.

The illustrated air-jet spinning machine 1 furthermore comprises a consolidating means, spaced apart from the drafting system 13 and embodied as an air spinning nozzle 3, having an internal vortex chamber (known from prior art and therefore not shown) and a yarn-forming element (likewise known and therefore also not shown) in the form of a hollow spindle that projects into the vortex chamber. In the vortex chamber, the fiber bundle 4 or at least a portion of the fibers in the fiber bundle 4 are provided with a protective twist by means of a swirled air flow generated by air nozzles in the vortex chamber.

Figure 2:
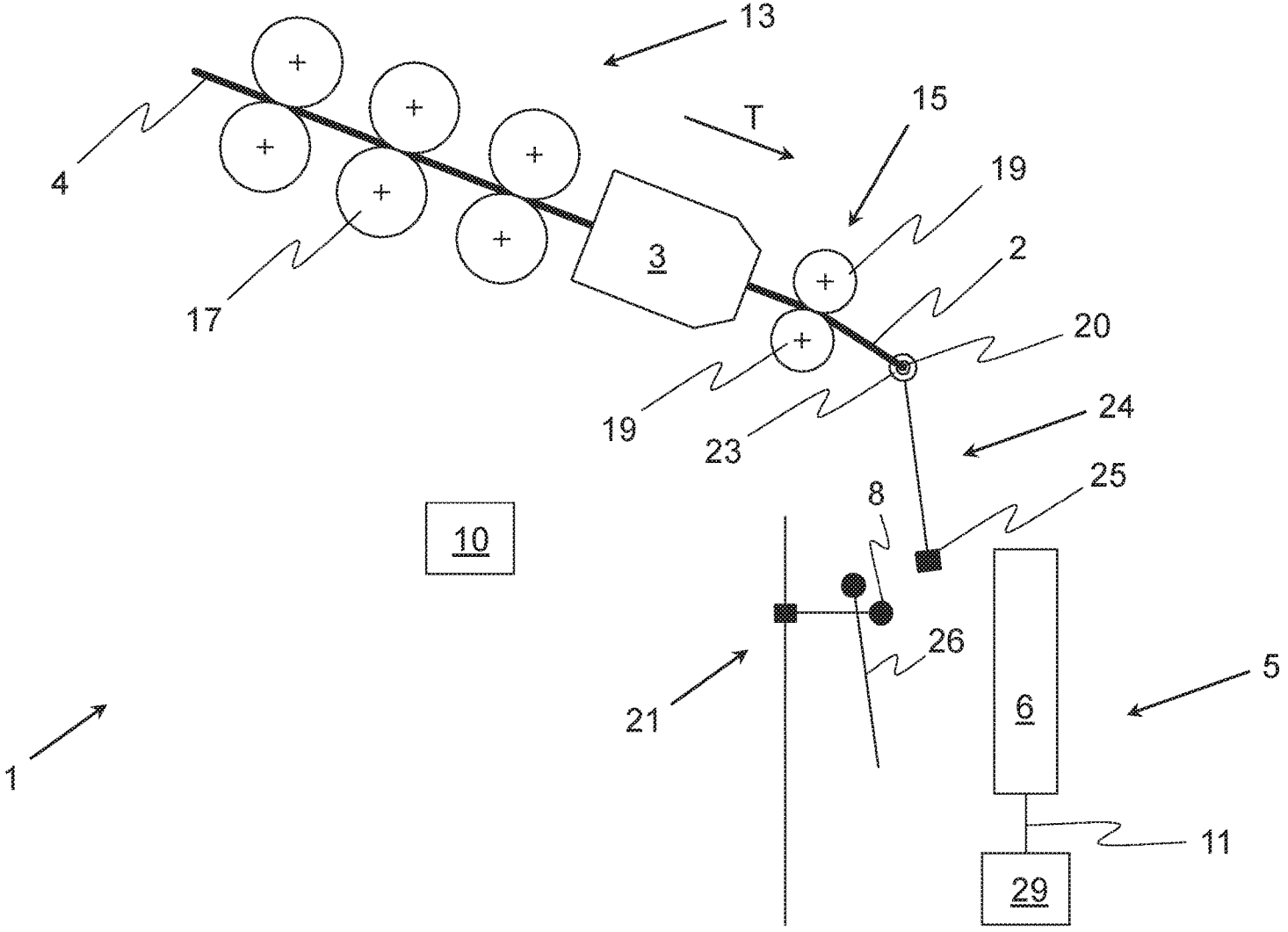
Figure 3:
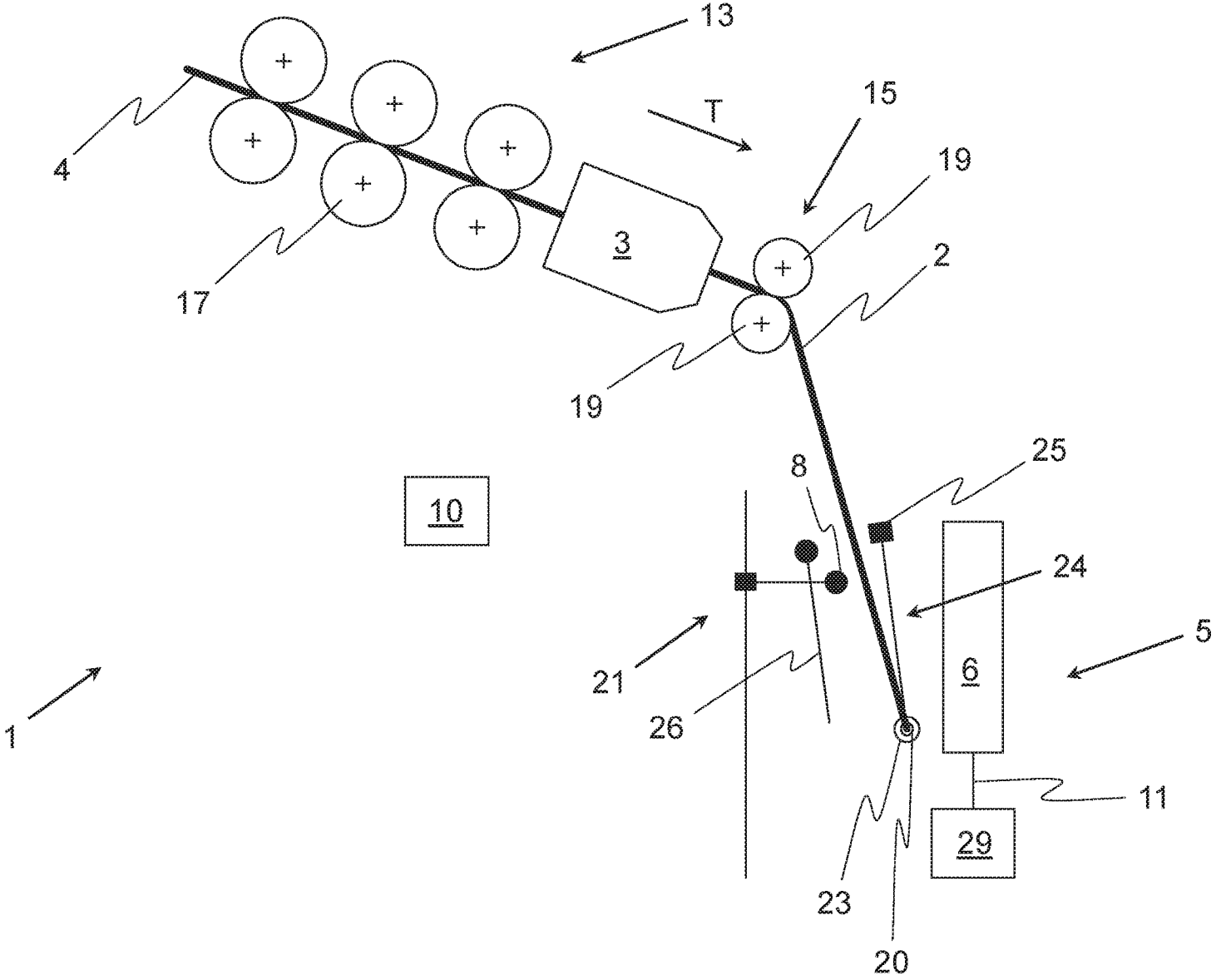
Figure 4:
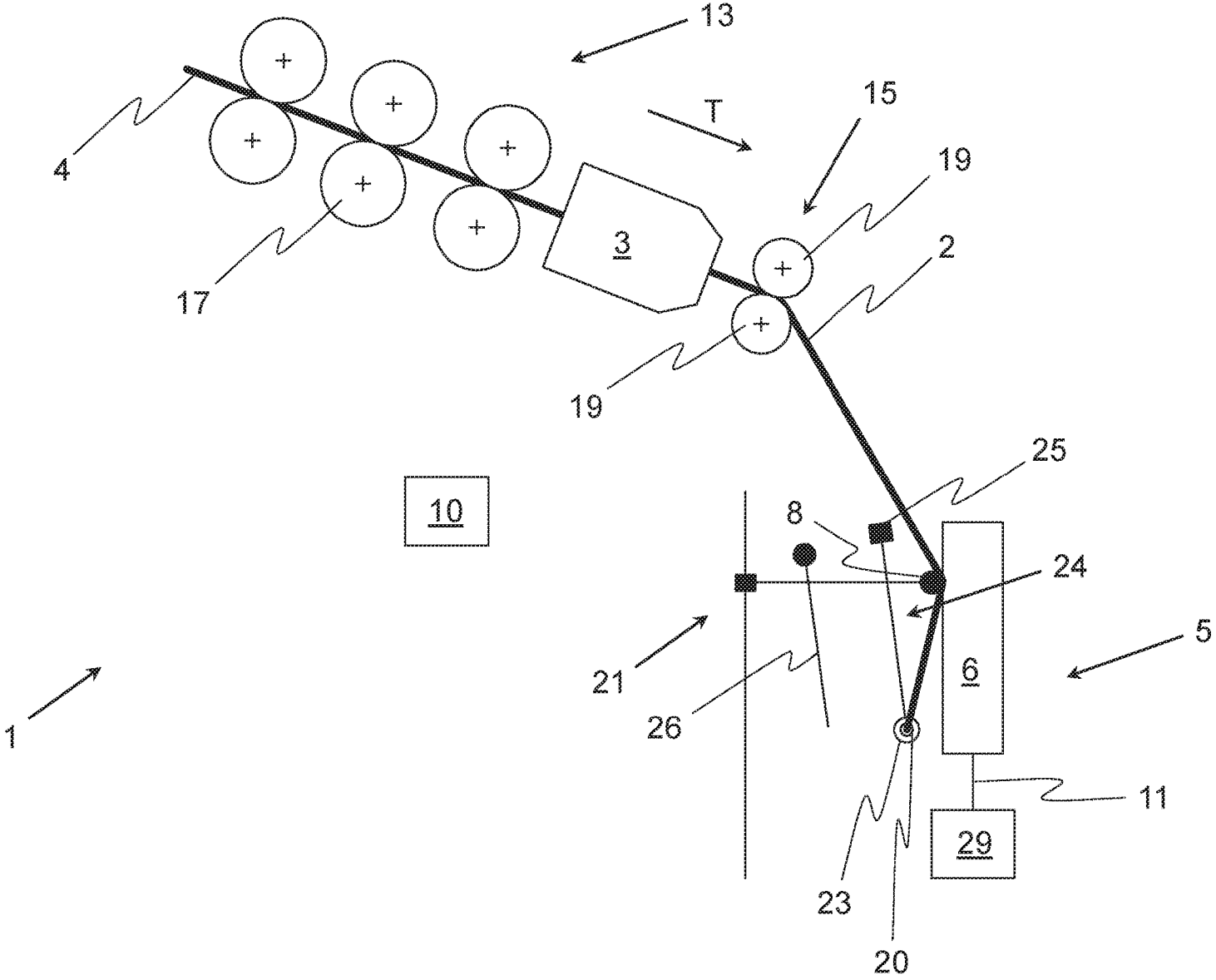

The air-jet spinning machine 1 may furthermore include a draw-off device 15 for the roving 2, arranged downstream of the drafting system 13 in the illustrated transport direction T and having for instance two draw-off rollers 19 (the draw-off device 15 is not absolutely necessary). Moreover, a winding device 5 is present that preferably receives at least two tubes 6 and by means of which it is possible to wind the roving 2 onto a tube 6, the roving 2 being guided by means of a traversing element 8 that can be moved back and forth in the direction of the double arrow shown in FIG. 1. The winding device 5 may in particular comprise a tube receiver 12 (e.g. in the form of a platform), that may be rotated by means of a drive and on which the tubes 6 may be fixed via corresponding holding devices (not shown in greater detail), wherein the holding devices and thus also the respective tubes 6 may be caused to rotate, preferably via separate drives, about a rotational axis 11 indicated in FIGS. 2 through 4 (such a tube drive 29 is indicated in FIGS. 2 through 4, wherein in this case as well, two holding devices, each having a separate tube drive 29, may be present that are preferably part of the tube receiver 12 depicted in FIG. 1).

The air-jet spinning machine 1 works according to a special air spinning method. For forming the roving 2, the fiber bundle 4 is guided in the transport direction T via an inlet opening (not shown) into the vortex chamber of the air spinning nozzle 3. There, it is given a protective twist, that is to say at least a portion of the fibers of the fiber bundle 4 is grasped by the aforesaid swirled air flow. A portion of the fibers is thereby pulled at least a little way out of the fiber bundle 4 and is wound around the tip of the yarn forming element which protrudes into the vortex chamber.

Finally, the fibers of the fiber bundle 4 are drawn out of the vortex chamber via an inlet opening of the yarn forming element and a draw-off channel which is arranged inside the yarn forming element and adjoins the inlet opening. In doing so, the free fiber ends are finally also drawn on a helical trajectory in the direction of the inlet opening and wrap as wrapping fibers around the centrally running core fibers, resulting in a roving 2 which has the desired protective twist.

Due to the only partial twisting of the fibers, the roving 2 has a draftability which is essential for the further processing of the roving 2 in a downstream spinning machine, for example a ring spinning machine. Conventional air-jet spinning devices, on the other hand, give the fiber bundle 4 such a pronounced twist that the required drafting following the yarn production is no longer possible. This is also desired in this case since conventional air-jet spinning machines are designed to produce a finished yarn, which is generally intended to be characterized by a high strength.

As explained in the foregoing, after leaving the air spinning nozzle 3, the roving 2 is wound onto a tube 6 by means of the winding device 5. If the respective tube 6 is adequately loaded with roving 2, it is exchanged for an empty tube 6, wherein the tube receiver 12 is rotated for this purpose about a preferably vertical rotational axis until the empty tube 6 shown in FIG. 1 is disposed in the position of the loaded tube 6 shown in FIG. 1 and vice versa.

While the empty tube 6 is being loaded with roving 2 following this tube exchange, a tube changing device 7 is activated that transfers the loaded tube 6 to a conveyor 18 (for instance in the form of a conveyor belt) of a tube transport device 28 that finally transports the tube 6 to a removal location (not shown). This conveyor 18, a plurality of which may be present, preferably comprises a plurality of tube holders 22 by means of which the tubes 6 may be held during their transport. Once the loaded tube 6 has been transported away, the position on the tube receiver 12 of the winding device 5 that has been freed up by this may be occupied by a new, empty tube 6, the tube changing device 7 preferably accomplishing this.

Alternatively, the winding device 5 could also have only one holding device for one tube 6. Finally, the illustrated guide 16 also does not necessarily have to be present, wherein in this case, for instance, the fiber bundle 4 may be inserted into the drafting system 13 immediately after it has left the container 14 (possibly after first going through a guide roller 27). It is also not absolutely necessary for the tube transport device 28 to be present.

Before normal operation of the air-jet spinning machine 1 indicated in FIG. 1 can be performed, during which the air spinning nozzle 3 continuously supplies roving 2, a start process has to take place. During this process, a fiber bundle 4 is supplied to the air spinning nozzle 3, preferably by means of the drafting system 13. Likewise, the aforesaid swirled air flow is generated inside the air spinning nozzle 3 such that a roving 2 is produced from the supplied fiber bundle 4 and finally leaves the air spinning nozzle 3 and is guided into the region of the winding device 5 and must be transferred to an empty tube 6.

FIGS. 2 through 4 now provide a schematic depiction of a segment of a textile machine according to the invention in the form of an air-jet spinning machine 1 at different times in a start process (wherein it should be noted at this point in general that the air-jet spinning machines 1 naturally may comprise a plurality of workstations in the form of corresponding spinning stations, wherein the individual spinning stations themselves have at least one separate air spinning nozzle 3 and one corresponding winding device 5).

During the start process, a fiber bundle 4 is supplied to the air spinning nozzle 3 by starting the drafting system 13. The roving 2 production described in the foregoing, in which the fiber bundle 4 obtains a protective twist, occurs in the air spinning nozzle 3. Finally, the roving 2 leaves the air spinning nozzle 3 via an outlet opening (not shown in the figures) and is gripped by the air flow of a suction unit 24 (which is part of a piecing arrangement that is used for performing a start process in which roving 2 produced by the air spinning nozzle 3 after the latter is started up may be brought into contact with an empty tube 6 disposed in the region of the winding device 5). The suction unit 24 preferably has a suction nozzle 23 with a suction opening 20 via which the air may be suctioned in and drawn inward, and thus also the roving 2 exiting the air spinning nozzle 3. Therefore, in this stage illustrated in FIG. 2, the roving 2 produced by the air spinning nozzle 3 leaves the air spinning nozzle 3 and is drawn via the suction opening 20 into the suction unit 24, wherein the supply speed of the air spinning nozzle 3 is preferably the same as or only slightly lower than the supply speed prevailing after the start process.

It should be stated in general at this point that the entire start process takes place preferably without interruption of the roving production and supply, i.e. with an active drafting system 13, active air spinning nozzle 3, and when present, an active draw-off device 15 (i.e. device drawing off roving 2 from the air spinning nozzle 3) so that a particularly high effectiveness of the illustrated air-jet spinning machine 1 may be ensured.

In addition, an indicated control 10 is provided that is mechanically linked to the described elements of the air-jet spinning machine 1 in order to perform, inter alia, the described start process and the tube changing process described in the following. There may be a control 10 for each spinning station for the air-jet spinning machine 1. It is also possible for one control to handle a plurality of spinning stations.

In the next step (see FIG. 3), the suction unit 24 is moved into a transfer position (the suction nozzle 23 is preferably pivoted about a swivel axle 25) in which the suction opening 20 and thus also a segment of the roving 2 (which also continues to be supplied by the air spinning nozzle 3) are located in the region of the tube surface—there is preferably no contact between tube 6 and roving 2 at this stage yet.

While the suction unit 24 assumes its position depicted in FIG. 3 (or shortly thereafter), the traversing element 8 of a traversing unit 21 is moved to the position indicated schematically in FIG. 4, in which position the roving 2 is gripped and guided by the traversing element 8. In doing so, the traversing unit 21 moves the roving 2 into the vicinity of the tube 6 or causes direct contact between tube 6 and roving 2 so that the roving 2 is gripped by the tube 6 (preferably under the influence of suitable rough surface segments on the tube 6).

At the same time, or shortly thereafter, a separating unit is activated that is also a component of the arrangement and that comprises, for instance, a movable (preferably pivotable) separating element 26. The separating element 26 is now brought into contact with the roving 2, preferably with the segment thereof that is disposed between traversing element 21 and suction opening 20. At this moment, there is local deceleration of the roving 2 in the region that comes into contact with the separating unit so that the roving 2 finally breaks between the tube 6 and the separating unit, since it continues to be wound by the rotating tube 6, i.e. a tractive force is acting on it. Breaking the roving 2 finally creates a segment of the roving 2 on the suction unit-side that can be discharged via the suction unit 24. A roving segment is also created on the air spinning nozzle-side, and it is already gripped by the tube 6 and extends between the air spinning nozzle 3 and the tube 6.

Because the tube 6 continues to rotate, the roving 2 that continues to be supplied by the air spinning nozzle 3 is finally continuously wound onto the tube 6, wherein the traversing element 8, with a movement in a direction running parallel to the rotation axis 11 of the tube 6, ensures that the roving 2 is wound uniformly onto the tube 6. In this stage, in which the separating element 26 and also the suction unit 24 have assumed their original positions, the air-jet spinning machine 1 is finally in its normal operation that follows the start process, in which the tube 6 is loaded with roving 2 until the desired tube size is attained and the loaded tube 6 can be replaced by a new, empty tube 6, wherein this can be carried without interrupting the roving production.

However, it is possible for the roving 2 to break between the air spinning nozzle 3 and the winding device 5 during normal operation, or for the drafting system 13 and/or the air spinning nozzle 3 to become clogged up with fibers, so that no more roving 2 is being produced in the air spinning nozzle 3. In all of these cases, the result is that no more roving 2 travels into the region of the winding device 5, wherein this may be recognized by means of a sensor system 9 that is only indicated in FIG. 1 (the sensor system 9 also comprises one or a plurality of sensors that may be placed in the region of the drafting system 13, the air spinning nozzle 3, the traversing unit 21, the winding device 5, or even between the aforesaid elements).

In any case, it is now provided according to the invention that when the sensor system 9 detects that no roving 2 is being produced by the air spinning nozzle 3, or that the roving 2 produced by the air spinning nozzle 3 is not being wound onto the tube 6, there is an interruption in normal operation and the tube 6 that was already partly loaded with roving 2 by means of the winding device 5 prior to the interruption in normal operation is replaced in a tube changing process by an empty tube 6, wherein this may occur preferably by means of the illustrated tube changing device 7 (or also manually).

In the next step (or even at the same time), the start process described in the foregoing is performed in which roving 2 produced by the air spinning nozzle 3 after a corresponding start up (during which the air spinning nozzle 3 is re-supplied with a fiber bundle 4) is brought into contact with an empty tube 6 that is now located in the winding device 5. Finally, the roving 2 produced and supplied by the air spinning nozzle 3 following the start process is wound onto the aforesaid tube 6 and normal operation is resumed.

The roving 2 produced after the interruption is thus not connected to the previously produced roving 2 that is wound onto the corresponding tube 6. On the contrary, whenever there is an unintended interruption in roving production or the winding process, there is an interruption in normal operation, during which the partly loaded tube 6 is replaced by an empty tube 6.

In a refinement of the invention, it may be provided that the interruption of normal operation and the subsequent tube changing process as well as the corresponding start process also occur when the aforesaid sensor system 9 recognizes that certain physical characteristics, such as, for instance, the thickness of the roving 2 leaving the air spinning nozzle 3, do not meet the desired requirements.

Finally, it is advantageous when the tubes 6 that are only partly loaded due to an interruption in normal operation are transported to a different location, preferably by means of the tube transport device 28, than the tubes 6 that were completely loaded without interruption of normal operation.

The present invention is not limited to the exemplary embodiments that have been shown and described. Modifications within the scope of the patent claims are also possible, as is any combination of the described features, even if they are shown and described in different parts of the description or the claims or in different exemplary embodiments.

REFERENCE LIST

1 Air-jet spinning machine
2 Roving
3 Air spinning nozzle
4 Fiber bundle
5 Winding device
6 Tube
7 Tube changing device
8 Traversing element
9 Sensor system
10 Control
11 Rotation axle
12 Tube receiver
13 Drafting system
14 Container
15 Draw-off device
16 Guide
17 Drafting roller
18 Conveyor
19 Draw-off roller
20 Suction opening
21 Traversing unit
22 Tube holder
23 Suction nozzle
24 Suction unit
25 Pivot axis of the suction nozzle
26 Separating element
27 Guide roller
28 Tube transport device
29 Tube drive
T Transport direction

The invention claimed is:

1. A method for operating a textile machine that produces a roving, comprising:

during normal operation of the textile machine, supplying a fiber bundle to a consolidating means of the textile machine, wherein the roving having a protective twist is produced from the fiber bundle by the consolidating means;

after leaving the consolidating means, winding the roving onto a tube with a winding device arranged downstream of the consolidating means in a transport direction of the roving;

with a sensor system fixed on the textile machine at a location relative to the winding device and the consolidating means to continuously monitor whether the roving is being produced by the consolidating means or whether the roving produced by the consolidating means is being wound onto the tube;

in the event that it is detected by the sensor system that no roving is being produced by the consolidating means or the roving produced by the consolidating means is not being wound onto the tube, an interruption of the normal operation of the textile machine is initiated;

replacing the tube partly loaded with roving by the winding device prior to the interruption in normal operation with an empty tube during a tube changing process;

in a start process, starting up the consolidating means and bringing the roving produced thereby into contact with the empty tube; and following the start process, resuming normal operation of the textile machine and winding the roving produced by the consolidating means onto the empty tube.

2. The method in accordance with claim 1, wherein the consolidating means comprises an air spinning nozzle, the roving having the protective twist produced from the fiber bundle inside the air spinning nozzle by means of a swirled air flow.

3. The method in accordance with claim 2, wherein during the interruption in normal operation, a drafting system that drafts the fiber bundle and is arranged upstream of the consolidating means in the transport direction is stopped, and a supply of the air introduced into the spinning nozzle during normal operation to generate the swirled air flow is stopped.

4. The method in accordance with claim 1, further comprising monitoring the roving produced by the consolidating means during normal operation of the textile machine with the sensor system for one or a plurality of physical characteristics of the roving running between the consolidating means and the tube, and when the one or plurality of monitored characteristics deviates from one or a plurality of target values of the running roving, the interruption of the normal operation of the textile machine is initiated.

5. The method in accordance with claim 1, wherein the tubes that are only partly loaded with roving due to the interruption in normal operation of the textile machine are transported to a collection or transfer point after the tube changing process that is separate from tubes that are completely loaded during normal operation of the textile machine.

6. The method in accordance with claim 1, wherein after the interruption in normal operation of the textile machine and prior to the resumption of normal operation, the consolidating means is cleaned to remove fibers of the fiber bundle or roving that is still located in the consolidating means.

7. The method in accordance with claim 1, wherein the start-up of the consolidating means is carried out during or after the tube changing process.

8. The method in accordance with claim 1, wherein the tube changing process, the start process, and the resumption of normal operation occurs within a maximum of 120 seconds after the interruption in normal operation of the textile machine.

9. A textile machine for producing a roving, comprising:

a consolidating means that produces a roving having a protective twist from a fiber bundle during normal operation of the textile machine;

a winding device arranged downstream of the consolidating means in a transport direction of the roving that winds the roving onto a tube;

a tube changing device that replaces the tube loaded by the winding device with an empty tube;

a sensor system comprising a sensor fixed on the textile machine relative to the winding device and the consolidating device to continuously monitor whether the roving is being produced by the consolidating means or whether the roving is being wound onto the tube;

a controller configured to:

interrupt the normal operation of the textile machine when it obtains from the sensor system a signal that no roving is being produced by the consolidating means or that the roving being produced by the consolidating means is not being wound onto the tube;

activate the tube changing device after the interruption in operation such that the tube already partly loaded with roving prior to the interruption in normal operation is replaced by an empty tube during a tube changing process;

following the interruption in normal operation, activating a start process in which the roving produced by the consolidating means during a start-up of the consolidating means is brought into contact with the empty tube;

activate the winding device such that the roving brought into contact with the tube is wound onto the tube; and operate the textile machine in normal operation again.

10. The textile machine in accordance with claim 9, wherein the sensor system monitors the roving produced by the consolidating means during normal operation for one or a plurality of physical characteristics of the roving running between the consolidating means and the tube being loaded, the controller further configured to initiate the interruption of normal operation when the one or plurality of characteristics deviates from one or a plurality of target values of the running roving.

11. The textile machine in accordance with claim 10, wherein the consolidating means comprises an air spinning nozzle, the roving having the protective twist produced from the fiber bundle inside the air spinning nozzle by means of a swirled air flow.

12. A method for operating a textile machine that produces a roving, comprising:

during normal operation of the textile machine, supplying a fiber bundle to a consolidating means of the textile machine, wherein the roving having a protective twist is produced from the fiber bundle by the consolidating means;

after leaving the consolidating means, winding the roving onto a tube with a winding device arranged downstream of the consolidating means in a transport direction of the roving;

with a sensor system operably configured on the textile machine relative to the winding device and the consolidating means, monitoring whether the roving is being produced by the consolidating means or whether the roving produced by the consolidating means is being wound onto the tube;

in the event that it is detected by the sensor system that no roving is being produced by the consolidating means or the roving produced by the consolidating means is not being wound onto the tube, an interruption of the normal operation of the textile machine is initiated;

replacing the tube partly loaded with roving by the winding device prior to the interruption in normal operation with an empty tube during a tube changing process;

in a start process, starting up the consolidating means and bringing the roving produced thereby into contact with the empty tube;

following the start process, resuming normal operation of the textile machine and winding the roving produced by the consolidating means onto the empty tube; and further comprising monitoring the roving produced by the consolidating means during normal operation of the textile machine with the sensor system arranged between the consolidating means and the tube being loaded for one or a plurality of physical characteristics of the roving running between the consolidating means and the tube, and when the one or plurality of monitored characteristics deviates from one or a plurality of target values of the running roving, the interruption of the normal operation of the textile machine is initiated.

13. A textile machine for producing a roving, comprising:

a consolidating means that produces a roving having a protective twist a fiber bundle during normal operation of the textile machine;

a winding device arranged downstream of the consolidating means in a transport direction of the roving that winds the roving onto a tube;

a tube changing device that replaces the tube loaded by the winding device with an empty tube;

a sensor system disposed on the textile machine relative to the winding device and the consolidating device to monitor whether the roving is being produced by the consolidating means or whether the roving is being wound onto the tube;

a controller configured to:

interrupt the normal operation of the textile machine when it obtains from the sensor system a signal that no roving is being produced by the consolidating means or that the roving being produced by the consolidating means is not being wound onto the tube;

activate the tube changing device after the interruption in operation such that the tube already partly loaded with roving prior to the interruption in normal operation is replaced by an empty tube during a tube changing process;

following the interruption in normal operation, activating a start process in which the roving produced by the consolidating means during a start-up of the consolidating means is brought into contact with the empty tube;

activate the winding device such that the roving brought into contact with the tube is wound onto the tube;

operate the textile machine in normal operation again; and wherein the sensor system is disposed between the consolidating means and the winding device to monitor the roving produced by the consolidating means during normal operation for one or a plurality of physical characteristics of the roving running between the consolidating means and the tube being loaded, the controller further configured to initiate the interruption of normal operation when the one or plurality of characteristics deviates from one or a plurality of target values of the running roving.

* * * * *